US007865092B2

(12) United States Patent
Murata et al.

(10) Patent No.: US 7,865,092 B2
(45) Date of Patent: Jan. 4, 2011

(54) WASTE TONER COLLECTING DEVICE AND IMAGE FORMING APPARATUS INCORPORATING THE SAME

(75) Inventors: Koji Murata, Osaka (JP); Yasuyuki Fukunaga, Osaka (JP); Chisato Hatakeyama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 319 days.

(21) Appl. No.: 12/155,745

(22) Filed: Jun. 9, 2008

(65) Prior Publication Data

US 2008/0317529 A1 Dec. 25, 2008

(30) Foreign Application Priority Data

Jun. 21, 2007 (JP) ..... 2007-164110

(51) Int. Cl.
*G03G 21/12* (2006.01)

(52) U.S. Cl. ..... 399/35; 399/71; 399/358; 399/360

(58) Field of Classification Search ..... 399/35, 399/71, 120, 349, 358, 360
See application file for complete search history.

(56) References Cited

U.S. PATENT DOCUMENTS 4,610,534 A * 9/1986 Ito et al. ..... 399/349
5,848,342 A * 12/1998 Tanda ..... 399/358
7,103,308 B2 * 9/2006 Wakana ..... 399/358
7,596,337 B2 * 9/2009 Sato ..... 399/101
7,725,070 B2 * 5/2010 Fukunaga et al. ..... 399/360

FOREIGN PATENT DOCUMENTS

JP 10-161501 6/1998

* cited by examiner

*Primary Examiner*—David M Gray
*Assistant Examiner*—Barnabas T Fekete
(74) *Attorney, Agent, or Firm*—Smith, Gambrell & Russell, LLP

(57) ABSTRACT

A waste toner collecting device includes: a tubular member provided with a toner inlet and a toner outlet; a roller that is provided upstream of the toner outlet in a toner transport direction inside the tubular member, that has a substantially horizontal rotation axis line, and that is elliptical in vertical section; a scraper that is provided on an inner wall of the tubular member on a downstream side of the toner outlet in a rotation direction of the roller, an edge of the scraper being in contact with the roller; and a waste toner collecting bag that is inflatable and is attached to the toner outlet of the tubular member.

8 Claims, 8 Drawing Sheets

WASTE TONER COLLECTING DEVICE AND IMAGE FORMING APPARATUS INCORPORATING THE SAME

This application is based on Japanese Patent Application No. 2007-164110 filed on Jun. 21, 2007, the contents of which are hereby incorporated by reference.

BACKGROUND OF THE INVENTION

1. Field of the Invention

The present invention relates to a waste toner collecting device for collecting residual toner remaining on the surface of an image carrier or an intermediate transfer body. The present invention also relates to an image forming apparatus incorporating this waste toner collecting device.

2. Description of Related Art

In electrophotographic image forming apparatuses, image transfer methods have been widely used in which a photoconductive drum serving as an image carrier and a transfer roller serving as a transfer member come in contact with or come close to each other to form a transfer region, paper is passed through the transfer region, and a toner image formed on the surface of the photoconductive drum is transferred onto the paper. With such transfer methods, a small amount of toner may remain on the surface of the photoconductive drum without being transferred to the paper. The residual toner remaining on the surface of the photoconductive drum needs to be cleaned off by a cleaning unit; otherwise, it may hinder the next image formation.

In an image forming apparatus in which a toner image formed on the surface of a photoconductive drum is primarily transferred to the surface of an intermediate transfer body, and then the toner image that has been transferred to the surface of the intermediate transfer body is secondary transferred to paper, a small amount of toner may also remain on the surface of the intermediate transfer body without being transferred to the paper. The residual toner remaining on the surface of the intermediate transfer body also needs to be removed by a cleaning unit.

Waste toner collected by a cleaning unit is transported through a pipe by use of a transport member such as a screw, and is collected by a waste toner collecting device. The waste toner collecting device is provided with a waste toner collecting container which receives and accommodates waste toner and a waste toner transport mechanism for transporting waste toner to the waste toner collecting container. The waste toner collecting container is typically formed of synthetic resin such as ABS resin. As a result, it is disadvantageously difficult to place the waste toner collecting container in a small space, or to have waste toner uniformly distributed to every corner of the waste toner collecting container.

One example of waste toner collecting devices proposed to deal with the above disadvantages is disclosed in JP-A-H10-161501. The waste toner collecting device is provided with an inflatable collecting bag as a waste toner collecting container.

Being provided with the inflatable collecting bag that can be inflated in a small space to make the most of the small space, this conventional waste toner collecting device can collect a larger amount of waste toner. Typically, however, in conventional waste toner collecting devices including this one, waste toner freely falls down from above into a collecting bag or a collecting container, the waste toner is liable to accumulate in and around the area under a toner inlet. In particular, in the case where the above-mentioned inflatable collecting bag is used, a toner flow path in the vicinity of the toner inlet may become narrower as a result of insufficient initial inflation of the collecting bag or change in the shape of the bag occurring as more waste toner is collected therein.

If waste toner keeps accumulating in the vicinity of the toner inlet as described above, the toner inlet soon becomes inconveniently clogged up with waste toner even when enough space is left for more waste toner at the rear portion inside the collecting bag. As a result, the waste toner collecting device needs to be replaced at an inconveniently high rate, and this may results in very high running cost, and there may arise a problem of waste toner overflowing from the toner inlet.

Also, the above described waste toner collecting device, in which waste toner is allowed to fall down freely from above into the waste toner collecting bag, needs to be structured such that the collecting bag extends below the waste toner transport mechanism. Therefore, in positioning the waste toner collecting device, sufficient space for allowing waste toner to fall down and for accommodating more waste toner needs to be secured in the vertical direction. This may limit, in terms of design, the overall structure of the waste toner collecting device and the internal structure of the image forming apparatus incorporating the toner collecting device.

SUMMARY OF THE INVENTION

The present invention has been made in view of the above problems, and an object of the present invention is to provide a waste toner collecting device whose structure is not limited in terms of design so that it can be structured, for example, to extend long in the lateral direction, and that is capable of securely accommodating a larger amount of waste toner, preventing waste toner from accumulating in the vicinity of a toner inlet. It is also an object of the present invention to provide a high-performance image forming apparatus incorporating such a waste toner collecting device.

To achieve the above objects, according to one aspect of the present invention, a waste toner collecting device is provided with: a tubular member provided with a toner inlet and a toner outlet; a roller that is provided upstream of the toner outlet in a toner transport direction inside the tubular member, has a substantially horizontal rotation axis line, and is elliptical in vertical section; a scraper that is provided on an inner wall of the tubular member on a downstream side of the toner outlet in a rotation direction of the roller, an edge of the scraper being in contact with the roller; and a waste toner collecting bag that is inflatable and is attached to the toner outlet of the tubular member.

With this structure, waste toner collected through the toner inlet can be sent further to the rear by the roller that is elliptical in vertical section, and can be prevented from flowing back by the operation of the scraper. Thus, even when the waste toner collecting bag has not been inflated to be very large compared with its initial state, or even when the waste toner collecting bag has been changed in shape as a result of an increasing amount of waste toner being collected therein, waste toner can be pushed further to the rear of the waste toner collecting bag. This makes it possible to prevent inconvenient accumulation of waste toner occurring in the vicinity of the toner inlet. Furthermore, since waste toner is sent to the rear of the waste toner collecting bag by use of the roller, it is not necessary for the waste toner collecting bag to be disposed such that it extends in the vertical direction. As a result, a waste toner collecting device can be obtained whose structure is not limited in terms of design and that is capable of securely accommodating a larger amount of waste toner, preventing waste toner from accumulating in the vicinity of a toner inlet.

According to the present invention, it is preferable that, in the waste toner collecting device structured as described above, the waste toner collecting bag be disposed to extend in a lateral direction.

This structure is very effective in a case where, although space for arranging the waste toner collecting bag cannot be secured in the vertical direction, sufficient space can be secured in the lateral direction. This greatly widens the applicability of the waste toner collecting device whose structure is not limited in terms of design so that it can be structured, for example, to extend long in the lateral direction, and that is capable of securely accommodating a larger amount of waste toner, preventing waste toner from accumulating in the vicinity of a toner inlet.

According to the present invention, it is preferable that, in the waste toner collecting device structured as described above, a coagulation preventing mechanism be provided to operate in contact with the waste toner collecting bag.

With this structure, waste toner can be sent to the rear of the waste toner collecting bag with an improved efficiency. Thus, waste toner can be efficiently sent into the waste toner collecting bag. As a result, accumulation of toner in the vicinity of the toner inlet can be prevented more effectively, and also, a larger amount of waste toner can be accommodated more effectively.

According to the present invention, it is preferable that, in the waste toner collecting device structured as described above, the coagulation preventing mechanism be provided with a rod member that moves back and forth along the direction in which the waste toner collecting bag extends and in contact with the waste toner collecting bag.

With this structure, the waste toner inside the waste toner collecting bag can be shaken with a simpler structure so that it is prevented from coagulating, and thus it can be sent to the rear of the waste toner collecting bag more effectively. This makes it possible to obtain, without cost increase, a waste toner collecting device that can prevent toner from accumulating in the vicinity of the toner inlet and securely accommodate a much larger amount of waste toner.

According to the present invention, it is preferable that, in the waste toner collecting device structured as described above, the coagulation preventing mechanism be provided with an endless belt member that rotates in contact with the toner collecting bag in the direction in which the waste toner collecting bag extends.

With this structure, it is possible to securely send waste toner to the rear of the waste toner collecting bag without allowing the waste toner to stay in the vicinity of the toner inlet or to flow back toward the toner inlet. As a result, a waste toner collecting device can be obtained that can prevent waste toner from accumulating in the vicinity of the toner inlet further more effectively, and thus can accommodate a much larger amount of waste toner.

According to the present invention, it is preferable that, in the waste toner collecting device structured as described above, the endless belt member have a projection on a surface thereof formed to project outward.

With this structure, a bump is formed in the waste toner collecting bag to rise toward the inside thereof and can be moved in the direction in which the waste toner collecting bag extends. This makes it possible to move the waste toner in the waste toner collecting bag up and down to prevent it from coagulating, and thus to send the waste toner to the rear of the waste toner collecting bag further more effectively. As a result, a waste toner collecting device can be obtained that can prevent waste toner from accumulating in the vicinity of the toner inlet more effectively, and thus can securely accommodate a much large amount of waste toner.

According to the present invention, it is preferable that, in the waste toner collecting device structured as described above, the coagulation preventing mechanism start operating according to a predetermined cycle.

With this structure, the coagulation preventing mechanism can be intermittently operated according to, for example, the accumulated driving time of the waste toner collecting device or the accumulated number of printed sheets. This makes it possible to reduce the running cost of the waste toner collecting device. Thus, the waste toner collecting device can be operated to collect more waste toner with as little cost increase as possible resulting from using it.

According to another aspect of the present invention, an image forming apparatus incorporates a waste toner collecting device that includes: a tubular member provided with a toner inlet and a toner outlet; a roller that is provided upstream of the toner outlet in a toner transport direction inside the tubular member, has a substantially horizontal rotation axis line, and is elliptical in vertical section; a scraper that is provided on an inner wall of the tubular member on a downstream side of the toner outlet in a rotation direction of the roller, an edge of the scraper being in contact with the roller; and a waste toner collecting bag that is inflatable and is attached to the toner outlet of the tubular member.

With this structure, it is possible for the waste toner collecting device to be structured without any limitation in terms of design so that it can be structured, for example, to extend long in the lateral direction, and also, it is possible to obtain a high-performance image forming apparatus that is capable of securely accommodating a larger amount of waste toner, preventing the waste toner from accumulating in the vicinity of the toner inlet.

According to the present invention, it is preferable that, in the image forming apparatus structured as described above, toner of a plurality of colors be used, and that there is only one of said waste toner collecting device for collecting all the toner of the plurality of colors.

With this structure, even an image forming apparatus that is capable of forming a color image using a plurality of colors does not need to be provided with as many waste toner collecting devices as the colors used therein, and thus the number of components can be reduced to achieve space saving. This makes it possible to realize an image forming apparatus that is compact and low-cost as well as advantageously capable of preventing waste toner from accumulating in the vicinity of a toner inlet to securely accommodate a larger amount of waste toner.

DETAILED DESCRIPTION OF PREFERRED EMBODIMENTS

A description will be given below of the preferred embodiments of the present invention with reference to FIGS. 1 to 8.

Figure 1:
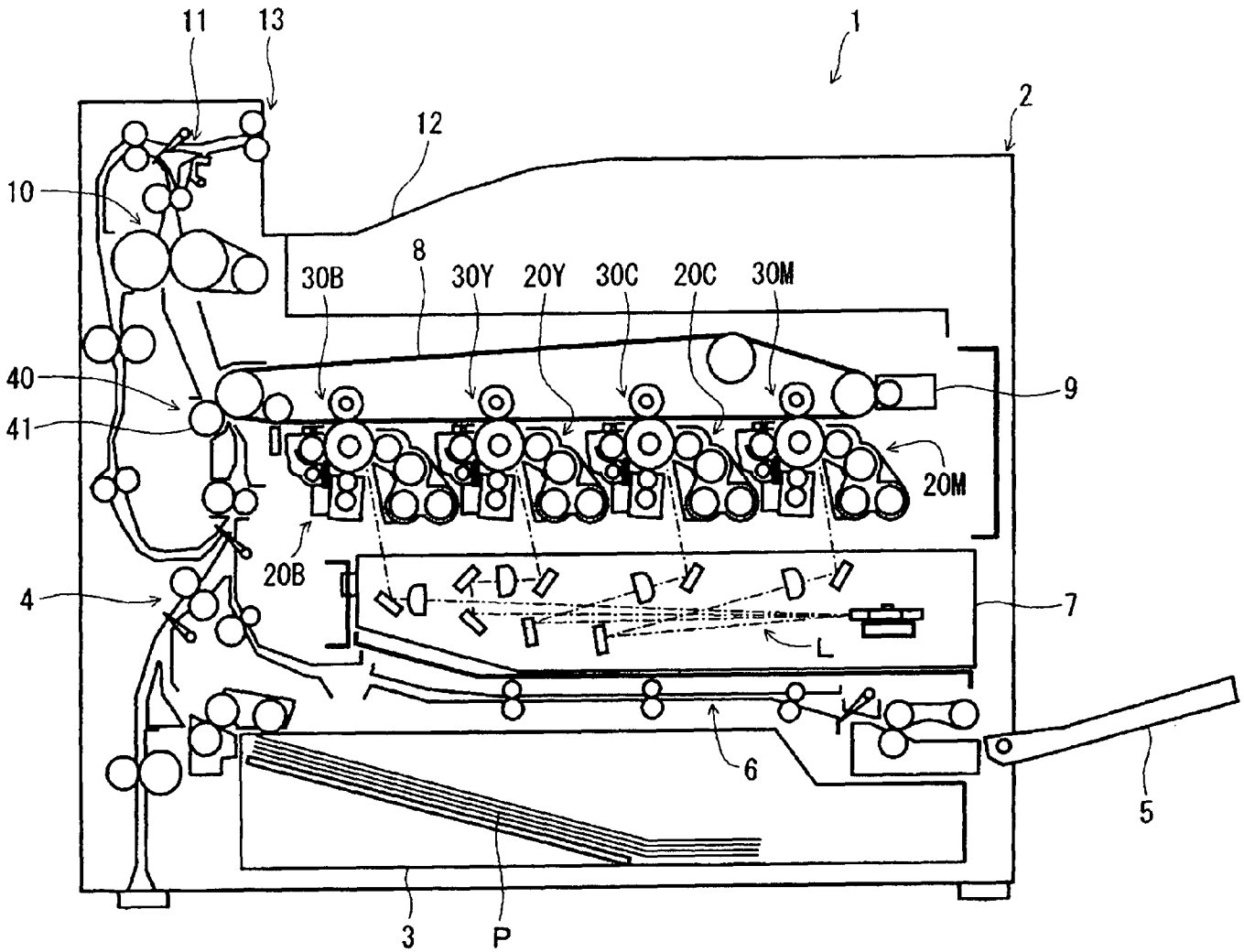
FIG. 1 is a vertical sectional front view schematically showing an image forming apparatus incorporating a waste toner collecting device of a first embodiment of the present invention.
Figure 2:
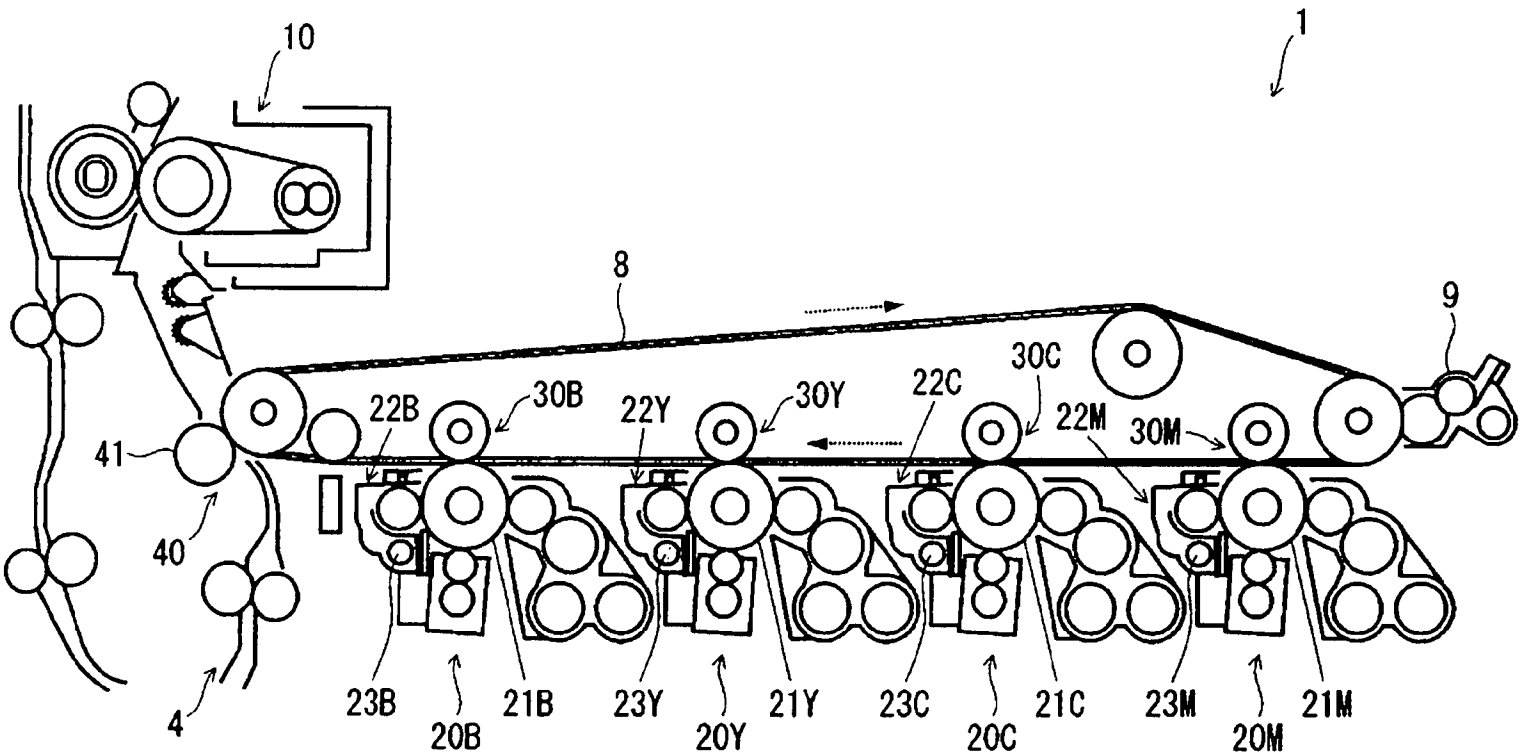
FIG. 2 is a partly enlarged vertical sectional view showing an image forming section of the image forming apparatus of FIG. 1 and the vicinity thereof.

First, with respect to an image forming apparatus incorporating the waste toner collecting device of a first embodiment of the present invention, a description will be given of its image output operation, along with a brief description of its structure with reference to FIGS. 1 and 2. FIG. 1 is a vertical sectional front view schematically showing the image forming apparatus, and FIG. 2 is a partly enlarged vertical sectional view showing an image forming section shown in FIG. 1 and the vicinity thereof. This image forming apparatus is of color printing type that uses an intermediate transfer belt to transfer a toner image onto paper.

As shown in FIG. 1, inside a main body 2 of the image forming apparatus 1, a paper feeding cassette 3 is disposed at the bottom. The paper feeding cassette 3 has a stack of paper P such as unprinted cut paper stored therein. The paper P is fed out separately one sheet after another toward the upper left of the paper feeding cassette 3 in FIG. 1. The paper feeding cassette 3 can be horizontally pulled out from the front face side of the main body 2.

Inside the main body 2, a first paper transport section 4 is provided to the left of the paper feeding cassette 3. The first paper transport section 4 is formed substantially vertically along the left side face of the main body 2. The first paper transport section 4 receives paper P sent from the paper feeding cassette 3 to transport it vertically upward along the left side face of the main body 2 to a secondary transfer section 40.

Above the paper feeding cassette 3, a manual paper feeding section 5 is provided at the right side face of the main body 2 that is a side face opposite from the left side face thereof along which the first paper transport section 4 is formed. On the manual paper feeding section 5 is put what needs to be fed in one sheet at a time such as paper P having a size that is different from the size of the paper P stored in the paper feeding cassette 3, thick paper, or an OHP sheet.

A second paper transport section 6 is provided to the left of the manual paper feeding section 5. The second paper transport section 6 is disposed right above the paper feeding cassette 3 and extends substantially horizontally from the manual paper feeding section 5 to the first paper transport section 4 to join the first paper transport section 4. The second paper transport section 6 receives the paper P or the like sent from the manual paper feeding section 5 to transport it substantially horizontally to the first paper transport section 4.

The image forming apparatus 1 receives image data of an original document from an external computer (unillustrated). This image data is sent to a laser light irradiating section 7 that is disposed above the second paper transport section 6 to serve as exposure means. The laser light irradiating section 7 irradiates an image forming section 20 with laser light L that is controlled according to the image data.

As shown in FIGS. 1 and 2, four image forming sections 20 in total are provided above the laser light irradiating section 7, and furthermore, above the four image forming sections 20, there is provided an intermediate transfer belt 8 that is an intermediate transfer body formed as an endless belt. The intermediate transfer belt 8 is wound around a plurality of rollers, and is driven to rotate clockwise by an unillustrated driving device.

As shown in FIGS. 1 and 2, the four image forming sections 20 are arranged in line from the upstream side to the downstream side along the rotation direction of the intermediate transfer belt 8; that is, they are arranged in a so-called tandem style. The four image forming sections 20 are, in the order from the upstream side in the rotation direction of the intermediate transfer belt 8, an image forming section 20M for magenta, an image forming section 20C for cyan, an image forming section 20Y for yellow, and an image forming section 20B for black. Each one of these image forming sections 20 is supplied with a developer (toner) by a developer supply container and transport means (unillustrated) corresponding thereto. In the following description, the identification symbols "M", "C", "Y", and "B" will be omitted unless required.

In each of the image forming sections 20, the surface of a photoconductive drum 21 is irradiated with laser light L by the laser light irradiating section 7 serving as the exposure means, and thereby an electrostatic latent image is formed thereon, from which a toner image is subsequently formed. The toner image is primarily transferred onto the surface of the intermediate transfer belt 8 at a primary transfer section 30 provided above the image forming sections 20. Then, with the rotation of the intermediate transfer belt 8, toner images of the four image forming sections 20 are transferred onto the intermediate transfer belt 8 at predetermined timings, and thereby a color toner image is formed on the surface of the intermediate transfer belt 8 by superposing on one another the toner images of the four colors of magenta, cyan, yellow, and black.

After the primary transfer, in each of the image forming sections 20, residual matter such as residual toner remaining on the surface of the photoconductive drum 21 is removed by a cleaning unit 22 for cleaning the photoconductive drum 21, and is collected in the cleaning unit 22. The waste toner that is temporarily collected in the cleaning unit 22 is then discharged by a toner discharge screw 23 toward a later-described waste toner collecting device that is located outside the cleaning unit 22.

At a place where the intermediate transfer belt 8 meets a paper transport passage, a secondary transfer section 40 provided with a secondary transfer roller 41 is disposed. At a secondary transfer nip portion formed by the intermediate transfer belt 8 and the second transfer roller 41 that are pressed against each other, the color toner image that is temporarily carried on the surface of the intermediate transfer belt 8 is transferred onto the paper P transported by the first paper transport section 4 in synchronism.

After the secondary transfer, residual matter such as residual toner remaining on the surface of each photoconductive drum 21 is removed by a cleaning unit 9 for cleaning the intermediate transfer belt 8 that is provided on the upstream side of the intermediate transfer belt 8 in the rotation direction of the image forming unit 20M for magenta, and is collected in the cleaning unit 9.

Above the secondary transfer section 40, a fixing section 10 is provided. The paper P carrying the unfixed toner image which has been transferred thereto at the secondary transfer section 40 is transported to the fixing section 10, where the toner image is fixed by being heated and pressed by a thermal roller and a pressure roller.

Above the fixing section 10, a branched portion 11 is provided. In the case where two-sided printing is not performed, the paper P is discharged from the fixing section 10 to the branched portion 11 to be ejected onto a paper ejection section 12 provided at the top of the image forming apparatus 1.

A paper outlet portion via which the paper P is ejected from the branched portion 11 onto the paper ejection section 12 serves as a switch back section 13. In the case where two-sided printing is performed, the transport direction of the paper P discharged from the fixing section 10 is switched at the switch back section 13. Then the paper P is transported back to the branched portion 11, then through a passage provided to extend downward along the left side of the fixing section 10 and the secondary transfer section 40, and then again via the first paper transport section 4 to the secondary transfer section 40.

Figure 3:
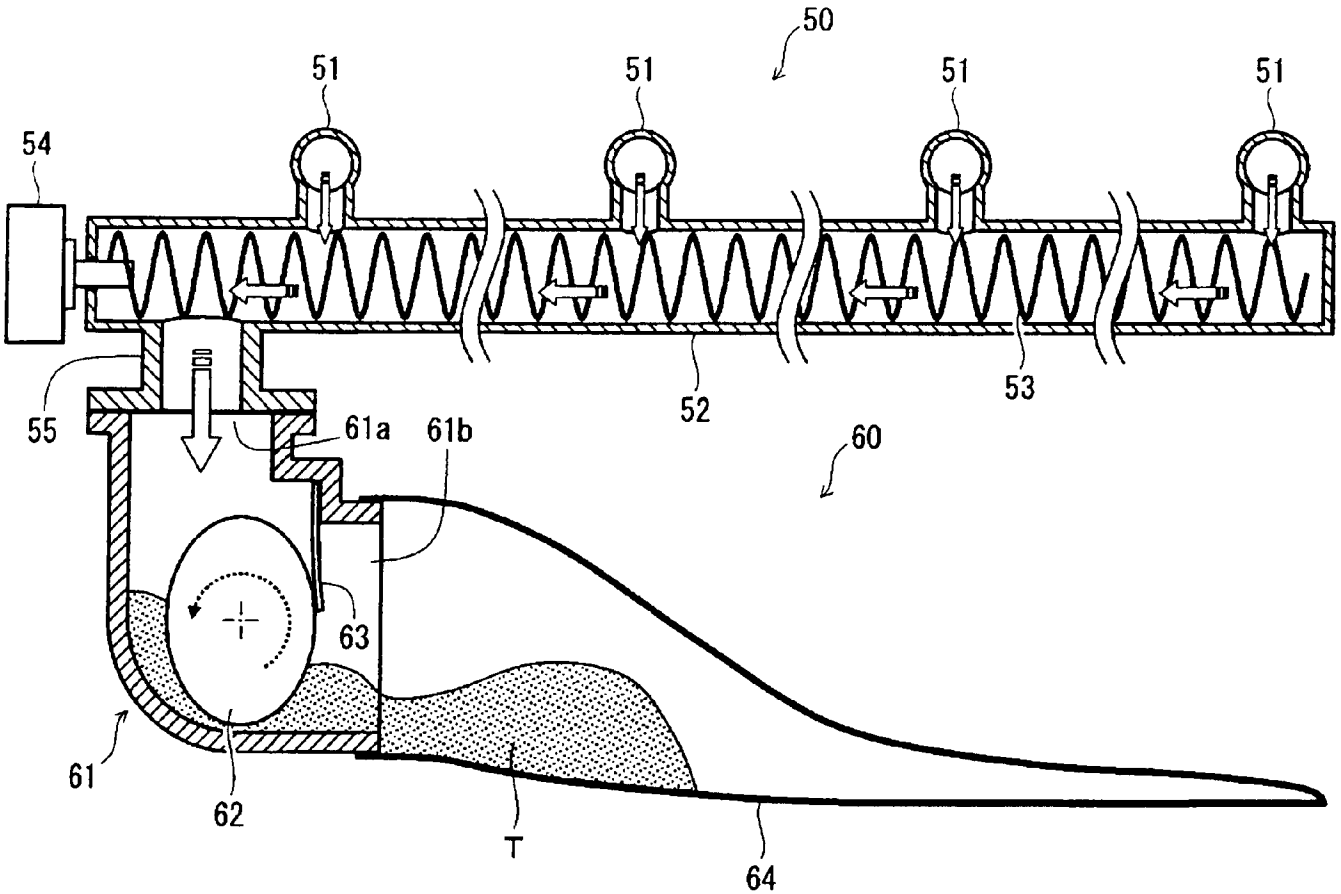
FIG. 3 is a vertical sectional front view showing the waste toner collecting device and the vicinity thereof.

Next, a detailed description will be given of the structure of the waste toner collecting device that collects the waste toner stored in all the cleaning units 22 of the image forming sections 20, with reference to FIG. 3 in addition to FIG. 2. FIG. 3 is a vertical sectional front view showing the waste toner collecting device and the vicinity thereof. Incidentally, in FIG. 3 and in FIGS. 4 to 8, a hollow arrow indicates the direction in which toner is transported.

As described above, waste toner temporarily stored in each cleaning unit 22 shown in FIG. 2 is discharged toward the outside thereof by the toner discharge screw 23. The discharged waste toner is, as shown in FIG. 3, collected by a waste toner gathering mechanism 50. The waste toner gathering mechanism 50 is provided between the cleaning units 22 and a single waste toner collecting device 60. Incidentally, the waste toner gathering mechanism 50 and the waste toner collecting device 60 are disposed on the front side inside the main body 2 of the image forming apparatus 1.

The waste toner gathering mechanism 50 is provided with four collecting pipes 51, a communication pipe 52, a transport spiral 53, a motor 54, and a discharge pipe 55.

The four collecting pipes 51 are each connected to a corresponding one of the four cleaning units 22, and waste toner is collected via the collecting pipes 51. Each of the collecting pipes 51 has the toner discharge screw 23 disposed therein. The four collecting pipes 51 are coupled to the single communication pipe 52 at the downstream end in the toner transport direction. Thus, waste toner discharged from each one of the cleaning units 22 is collected in the communication pipe 52

The communication pipe 52 extends in the lateral direction of the image forming apparatus 1, and inside the communication pipe 52, the transport spiral 53, which is coupled to the motor 54, is disposed along the direction in which the communication pipe 52 extends. When the motor 54 is driven to make the transport spiral 53 rotate, the waste toner in the communication pipe 52 can be transported to one end thereof, specifically to the left end side in FIG. 3. The discharge pipe 55 is coupled to the communication pipe 52 in the vicinity of the left end of the communication pipe 52. The discharge pipe 55 extends downward from the lower side of the communication pipe 52 down to where the waste toner transported through the communication pipe 52 freely falls down to be discharged.

The waste toner collecting device 60 is connected to the discharge pipe 55 of the waste toner gathering mechanism 50 structured as described above, and takes in waste toner via the discharge pipe 55. The waste toner collecting device 60 is provided with a tubular member 61, a roller 62, a scraper 63, and a waste toner collecting bag 64.

The tubular member 61 is an angular tube having an L-shaped vertical section as seen from the front. The lower inner wall of the tubular member 61 that is L-shaped in section is formed as a smooth curved surface so as to fit the peripheral surface of a later-described roller 62. The tubular member 61 shaped as described above is provided with: at its top, a toner inlet 61*a* facing upward; and, at its bottom, a toner outlet 61*b* facing sideways, that is, facing to the right in FIG. 3. Waste toner T collected by the cleaning units 22 of the image forming apparatus 1 is dropped through the toner inlet 61*a* into the tubular member 61 and is discharged from the toner outlet 61*b*.

The roller 62 is disposed upstream of the toner outlet 61*b* in the toner transport direction inside the tubular member 61. The roller 62 has a rotation axis line that is substantially horizontal and is perpendicular to the toner transport direction; that is, the roller 62 extends in the depth direction of the paper surface of FIG. 3, and has an elliptical vertical section as seen from the axis line direction. The roller 62 having the elliptical vertical section is so sized that it can rotate around its axis line inside the tubular member 61, and is made to rotate clockwise in FIG. 3 by an unillustrated motor.

The scraper 63 is provided on an inner wall of the tubular member 61, the inner wall being on the downstream side of the toner outlet 61*b* in the rotation direction of the roller 62; that is, the scraper 63 is provided on an inner wall of the tubular member 61 above the roller 62. The scraper 63 is a film member that is substantially as long as the roller 62 in the axis line direction and extends downward to the roller 62. The scraper 63 is positioned to be in contact with the roller 62 with an edge thereof positioned on the downstream side of the roller 62 in the toner transport direction and pressed against the roller 62 to be slightly curved.

The waste toner collecting bag 64 is attached to the toner outlet 61*b* of the tubular member 61. The waste toner collecting bag 64, which is an inflatable bag formed of synthetic resin or aluminum-deposited material, can be inflated to be box-shaped when it is full of the waste toner T. The waste toner collecting bag 64 is disposed, for example, on an unillustrated frame or the like so as to extend in the lateral direction.

Figure 4:
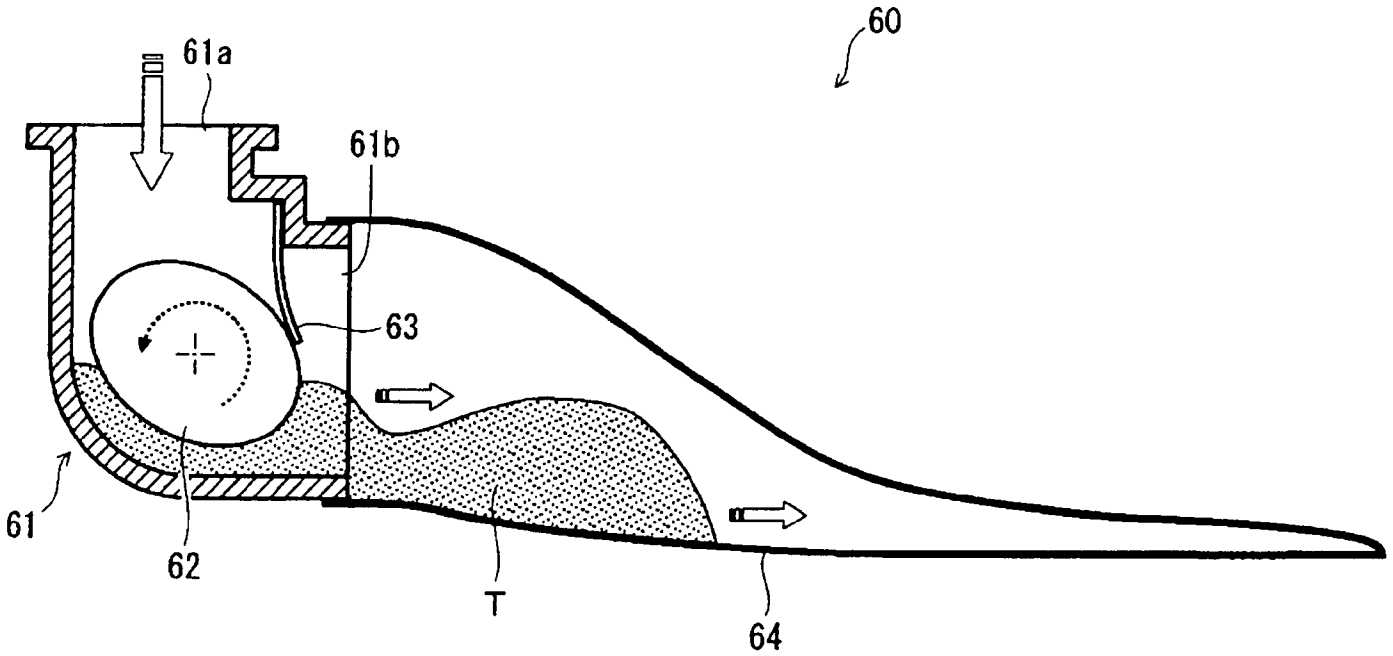
FIG. 4 is a vertical sectional front view of the waste toner collecting device shown in FIG. 3 in a state where a roller has been further rotated from the state shown in FIG. 3.

Next, a description will be given of how the waste toner T is collected by the waste toner collecting device 60 with reference to FIGS. 4 and 5 in addition to FIG. 3. FIG. 4 is a vertical sectional front view of the waste toner collecting device shown in FIG. 3 in a state where a roller is further rotated from the state shown in FIG. 3, and FIG. 5 is a vertical sectional front view of the waste toner collecting device shown in FIG. 4 in a state where the roller is further rotated from the state shown in FIG. 4.

As shown in FIG. 3, the waste toner T is dropped through the toner inlet 61*a* from above into the tubular member 61. Then the waste toner T dropped into the tubular member 61 falls along the peripheral surface of the roller 62, and a large amount thereof is accumulated between the roller 62 and the inner wall of the tubular member 61, particularly at minor axis portions of the roller 62.

Here, as described above, the roller 62 that is elliptic in vertical section is so sized that it can rotate around its axis line inside the tubular member 61. Thus, as shown in FIGS. 3 to 5, the roller 62 rotates, in the lower portion of the tubular member 61, with major axis portions of its surface coming closest to the smooth curved surface of the inner wall of the tubular member 61.

Figure 5:
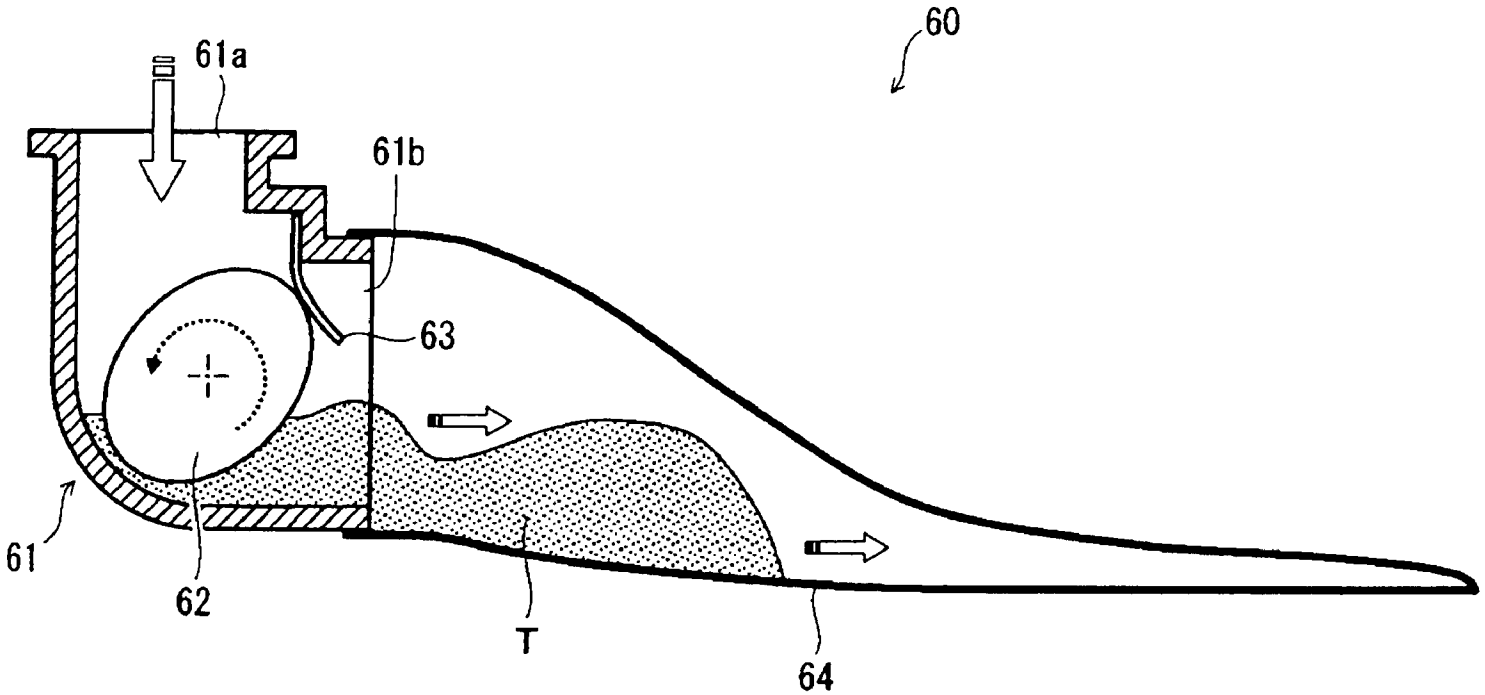
FIG. 5 is a vertical sectional front view of the waste toner collecting device shown in FIG. 4 in a state where the roller has been further rotated from the state shown in FIG. 4.

When the roller 62 is rotated from the state shown in FIG. 3 to the state shown in FIG. 4 and further to the state shown in FIG. 5, the major axis portion of the roller 62 moves the waste toner T accumulated at a toner outlet 61*b*-side minor axis portion thereof toward the waste toner collecting bag 64 in a scraping manner.

When the roller 62 continues to rotate, major axis portions of the roller 62 continue to move the waste toner T accumulated at the minor axis portions of the roller 62 in a scraping manner toward the waste toner collecting bag 64.

As described above, the scraper 63 is provided above the roller 62. Since the scraper 63 is in contact with the roller 62 with an edge thereof pressed against the roller 62, it can scrape off the waste toner T remaining on the surface of the roller 62. Furthermore, when the waste toner T has accumulated as high as the upper portion of the roller 62, the scraper 63 can push the waste toner T into the waste toner collecting bag 64 with its edge being shaken according to the rotation of the roller 62.

As described above, the waste toner collecting device 60 is provided with: the tubular member 61 in which the toner inlet 61*a* and the toner outlet 61*b* are formed; the roller 62 that is provided upstream of the toner outlet 61*b* in the toner transport direction inside the tubular member 61, that has a substantially horizontal rotation axis line, and that has an elliptic vertical section; the scraper 63 that is provided on an inner wall of the tubular member 61 on the downstream side of the toner outlet 61*b* in the rotation direction of roller 62 and an edge of which is pressed against the roller 62; and the waste toner collecting bag 64 that is inflatable and is attached to the toner outlet 61*b* of the tubular member 61, and thus the waste toner T collected through the toner inlet 61*a* can be moved further to the rear by the roller 62 having an elliptic vertical section, and reverse flow of the waste toner T can be prevented by the function of the scraper 63. This makes it possible to move the waste toner T toward the rear of the waste toner collecting bag 64 even when the toner has not been inflated very much from its initial state, or even when the shape of the waste toner collecting bag 64 has changed as more waste toner T is collected therein. This prevents the inconvenience of the waste toner T accumulating in the vicinity of the toner inlet 61*a*. Furthermore, since the waste toner T is moved toward the rear of the waste toner collecting bag 64 by use of the roller 62, there is no need of disposing the waste toner collecting bag 64 such that it extends in the vertical direction. As a result, the waste toner collecting device 60, whose structure is not limited in terms of design, can be so efficient that it can securely accommodate a much larger amount of waste toner, preventing waste toner from accumulating in the vicinity of the toner inlet 61*a*.

Also, the feature that the waste toner collecting bag 64 is disposed to extend in the lateral direction is very effective in the structure where, although space for arranging the waste toner collecting bag 64 cannot be secured in the vertical direction, sufficient space can be secured in the lateral direction. This greatly widens the applicability of the waste toner collecting device 60 whose structure is not limited in terms of design so that it can be structured, for example, to extend long in the lateral direction, and that is capable of securely accommodating more waste toner T, preventing waste toner from accumulating in the vicinity of the toner inlet 61*a*.

The image forming apparatus 1 incorporates the waste toner collecting device 60, whose structure is not limited in terms of design, that can be structured to extend long in the lateral direction, and that can securely accommodate a much larger amount of waste toner T, preventing the waste toner T from accumulating in the vicinity of toner inlet 61*a*; thus, the image forming apparatus 1 can be a high-performance image forming apparatus.

Furthermore, since the image forming apparatus 1 in which toner of a plurality of colors is used also has the single waste toner collecting device 60 provided therein for collecting the toner of all the plurality of colors, the image forming apparatus 1, which is capable of forming a color image using a plurality of colors, does not need to be provided with as many waste toner collecting devices 60 as the colors used therein, and the number of components can be reduced and space saving can be achieved. This makes it possible to make the image forming apparatus 1 compact and low-cost, as well as to achieve the advantage of securely collecting more waste toner T by preventing it from accumulating in the vicinity of the toner inlet 61*a*.

Figure 6:
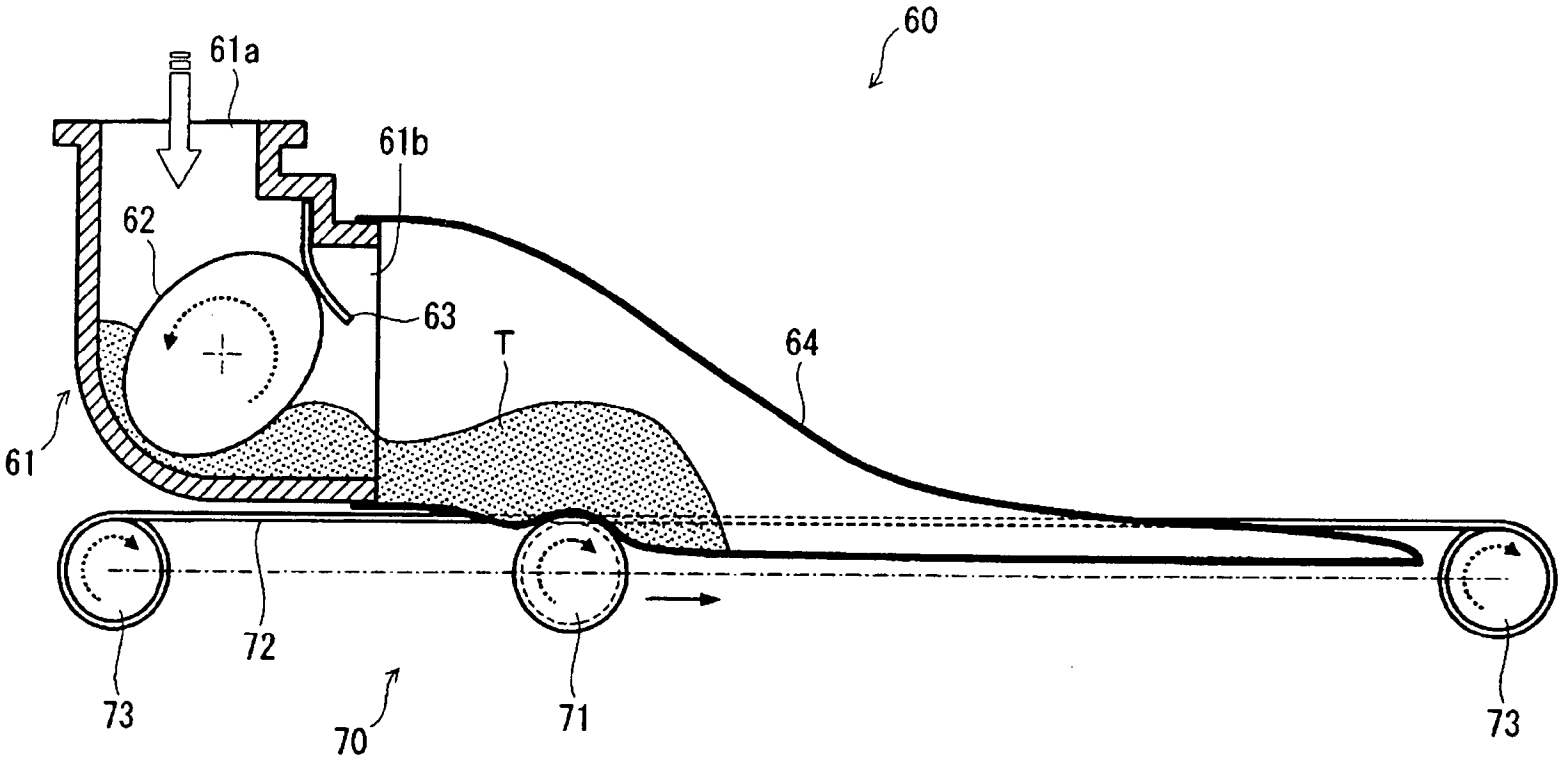
FIG. 6 is a vertical sectional front view showing a waste toner collecting device of a second embodiment of the present invention.
Figure 7:
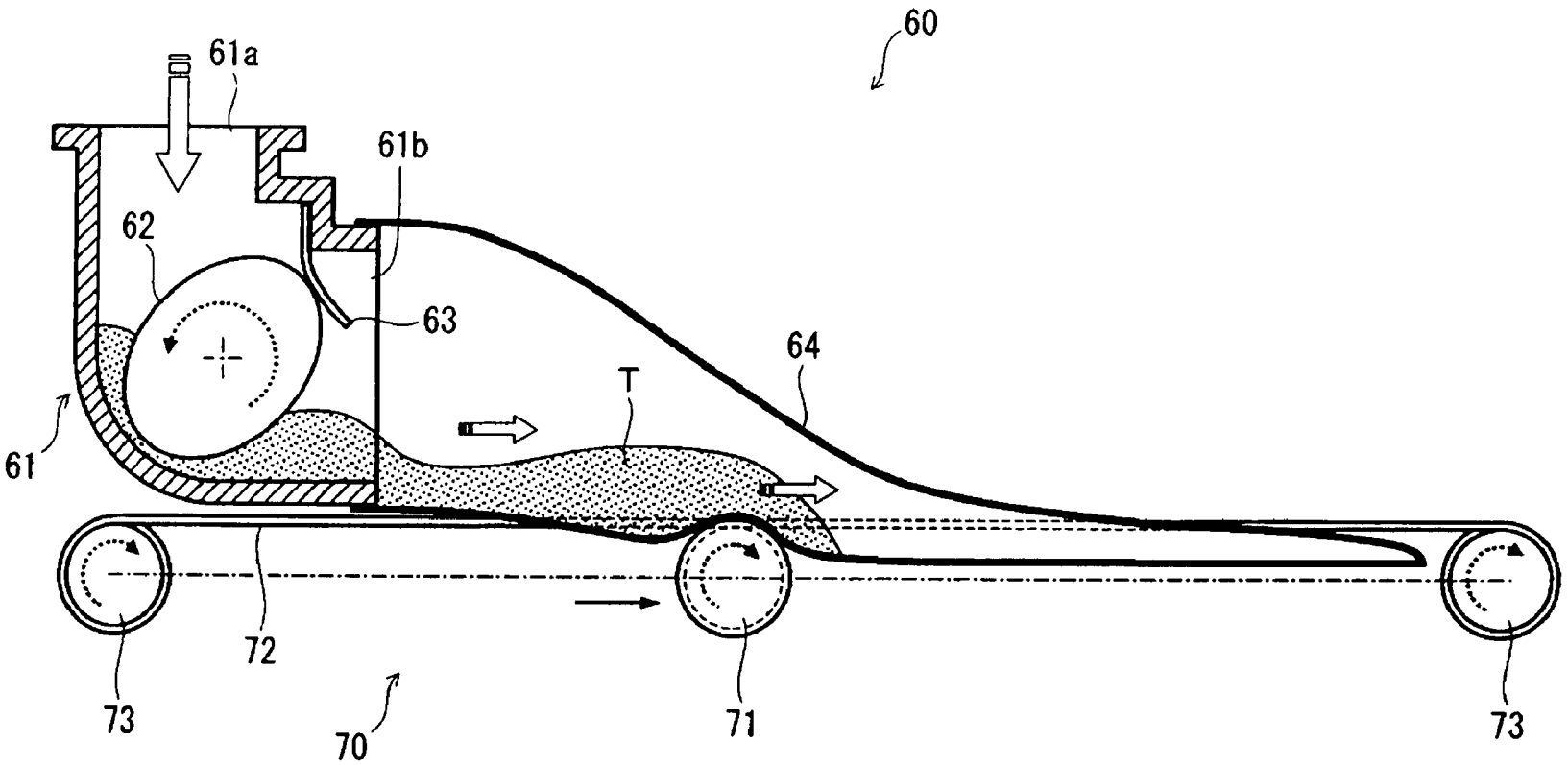
FIG. 7 is a vertical sectional front view of the waste toner collecting device shown in FIG. 6 in the state where a coagulation preventing mechanism for waste toner is in operation.

Next, a description will be given of a waste toner collecting device of the second embodiment of the present invention, with reference to FIGS. 6 and 7. FIG. 6 is a vertical sectional front view showing a waste toner collecting device, and FIG. 7 is a vertical sectional front view showing a state where a coagulation preventing mechanism of the waste toner collecting device shown in FIG. 6 is being operated. Incidentally, since the basic structure of this embodiment is the same as that of the first embodiment described above with reference to FIGS. 1 to 5, such components as find their counterparts in the first embodiment are identified with common reference numerals, and their descriptions will be omitted.

As shown in FIG. 6, the waste toner collecting device 60 of the second embodiment is provided with a coagulation preventing mechanism 70 for preventing coagulation of the waste toner T below the tubular member 61 and the waste toner collecting bag 64. The coagulation preventing mechanism 70 is provided with a rod member 71, a wire 72, and two driving rollers 73.

The rod member 71 has a rotation axis line that is substantially horizontal and perpendicular to the direction in which toner is transported, and extends in the depth direction of the paper surface of FIG. 6. The rod member 71 is disposed to be in contact with the waste toner collecting bag 64 from below. Incidentally, the rod member 71 is permitted by an unillustrated slide mechanism to move only in the direction in which the waste toner collecting bag 64 extends, that is, rightward and leftward in FIG. 6.

The wire 72 is provided one at either end of the rod member 71. The wire 72 is wound at least once around the periphery surface of the rod member 71, and the two ends thereof extend from the top portion of the rod member 71 in the direction in which the waste toner collecting bag 64 extends, that is, rightward and leftward in FIG. 6.

The driving rollers 73 are arranged in two locations, that is, under the tubular member 61 and under the edge of the waste toner collecting bag 64. In the same manner as the rod member 71, the driving rollers 73 each have a rotation axis line that is substantially horizontal and perpendicular to the toner transport direction, and extend in the depth direction of the paper surface of FIG. 6. Two end portions of the wire 72 are connected to the driving rollers 73. Furthermore, the two driving rollers 73 are coupled to a motor and a driving mechanism (both unillustrated) such that they rotate concurrently with each other, in the same direction at the same speed.

In the coagulation preventing mechanism 70 shown in FIG. 6, when the two driving rollers 73 are rotated clockwise such that the wires 72 are unwound from the left one of the driving rollers 73 and are accordingly wound around the right one of the driving rollers 73, the rod member 71 rotates clockwise to move in the toner transport direction, i.e., toward the right side, in accordance with the movement of the wires 72 that are wound around it.

This shakes the waste toner T in the waste toner collecting bag 64 up and down, and thereby coagulation of the waste toner T can be prevented, and thus as shown in FIG. 7, the waste toner T can be moved toward the rear of the waste toner collecting bag 64 more easily.

In FIGS. 6 and 7, when the two driving rollers 73 are rotated counterclockwise, the rod member 71 moves toward the left side. At this time, too, the waste toner T in the waste toner collecting bag 64 is shaken up and down from below, and thereby coagulation of the waste toner T can be prevented.

As described above, the provision of the coagulation preventing mechanism 70 that operates in contact with the waste toner collecting bag 64 for preventing coagulation of the waste toner T improves the function of moving waste toner to the rear of the waste toner collecting bag 64. This makes it possible to efficiently send the waste toner T into the waste toner collecting bag 64. Thus, accumulation of the waste toner T in the vicinity of the toner inlet 61*a* can be prevented with enhanced effectiveness, and also, a larger amount of waste toner T can be accommodated more effectively.

Since the coagulation preventing mechanism 70 is provided with the rod member 71 that moves back and forth in contact with the waste toner collecting bag 64 in the direction in which the waste toner collecting bag 64 extends, it can prevent coagulation of the waste toner T in the waste toner collecting bag 64 by shaking it with a simpler structure, and helps improve the function of sending the waste toner T to the rear of the waste toner collecting bag 64. Thus, the waste toner collecting device 60 can be obtained that can prevent toner from accumulating in the vicinity of the toner inlet 61*a* and can securely accommodate a much larger amount of waste toner T with cost increase prevented.

Figure 8:
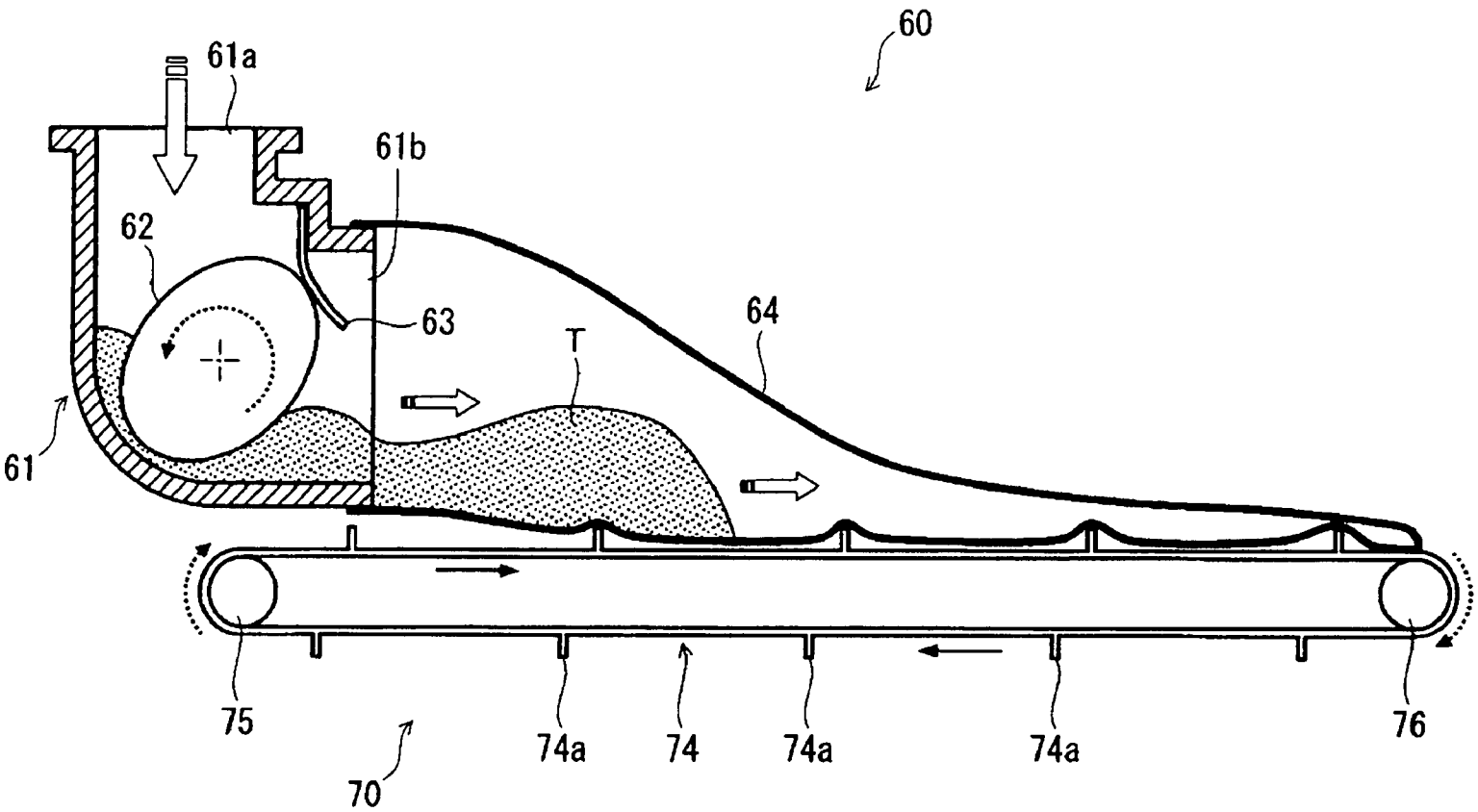
FIG. 8 is a vertical sectional front view showing a waste toner collecting device of a third embodiment of the present invention.

Next will be given a description of the structure of a waste toner collecting device of the third embodiment of the present invention with reference to FIG. 8. FIG. 8 is a vertical sectional front view showing a waste toner collecting device. Since the basic structure of this embodiment is the same as that of the first embodiment described above with reference to FIGS. 1 to 5, such components as find their counterparts in the first embodiment are identified with common reference numerals, and their descriptions will be omitted.

As shown in FIG. 8, the waste toner collecting device 60 of the third embodiment is provided with a coagulation preventing mechanism 70 for preventing coagulation of the waste toner T below the tubular member 61 and the waste toner collecting bag 64. The coagulation preventing mechanism 70 is provided with a belt 74, a driving roller 75, and a driven roller 76.

The belt 74 is an endless belt member, and is provided to extend substantially horizontally in the direction in which the waste toner collecting bag 64 extends, that is, rightward and leftward in FIG. 8. The belt 74 is disposed to be in contact with the waste toner collecting bag 64 from below. On a surface of the belt 74, a plurality of projections 74*a* are formed to project outward.

The belt 74 is wound around the driving roller 75 and the driven roller 76. The driving roller 75 is coupled to an unillustrated motor, which rotates the belt 74 clockwise in FIG. 8 via the driving roller 75.

When the coagulation preventing mechanism 70 structured as described above is operated, the belt 74 rotates with the top surface thereof in contact with the bottom of the waste toner collecting bag 64. Meanwhile, with the rotation of the belt 74, the projections 74*a* formed on the surface of the belt 74 move in the toner transport direction, that is, to the right in FIG. 8, being in contact with the lower portion of the waste toner collecting bag 64.

As described above, since the coagulation preventing mechanism 70 is provided with the belt 74 that is an endless belt member rotating, being in contact with the waste toner collecting bag 64, in the direction in which the waste toner collecting bag 64 extends, it can securely move the waste toner T to the rear of the waste toner collecting bag 64 without allowing the waste toner T to accumulate in the vicinity of the toner inlet 61*a* or to flow back toward the toner inlet 61*a*. Thus, the waste toner collecting device 60 can be obtained that is further improved in the function of preventing accumulation of the waste toner T in the vicinity of the toner inlet 61*a* and thus can accommodate a larger amount of waste toner T.

In addition, the belt 74 is provided with the projections 74*a* on the surface thereof formed to project outward, and as a result, there are formed bumps in the waste toner collecting bag 64 that rise toward the inside thereof and move in the direction in which the waste toner collecting bag 64 extends. This makes it possible to shake the waste toner T in the waste toner collecting bag 64 up and down to prevent it from coagulating, and thus to move it to the rear of the waste toner collecting bag 64 much more effectively. Thus, the waste toner collecting device 60 can be obtained that is further improved in the function of preventing accumulation of the waste toner T in the vicinity of the toner inlet 61*a*, and thus can accommodate a much larger amount of waste toner T.

The coagulation preventing mechanism 70 in the waste toner collecting device 60 described in the second embodiment and that described in the third embodiment start operating according to a predetermined cycle. Thus, the coagulation preventing mechanism 70 can be intermittently operated according to, for example, the accumulated driving time of the waste toner collecting device 60 or the accumulated number of printed sheets of paper. This makes it possible to reduce the running cost of the waste toner collecting device 60. Thus, the waste toner collecting device 60 can be operated to collect a larger amount of waste toner T with as little cost increase as possible resulting from using it.

It should be understood that the present invention may be carried out in any manner other than specifically described above as embodiments, and many modifications and variations are possible within the scope and spirit of the present invention.

For example, the embodiments described above deal with the case where the image forming apparatus 1 is of a color-printing type in which toner images of a plurality of colors are transferred onto paper P by used of the intermediate transfer belt 8, but this is not meant to limit the type of the image forming apparatus, and it may be one that does not use an intermediate transfer belt, or one for monochrome printing.

In the embodiments described above, the waste toner collecting device 60 collects waste toner from the four different cleaning units 22 for the four different photoconductive drums 21 via the waste toner gathering mechanism 50, but waste toner can also be collected from the cleaning unit 9 for the intermediate transfer belt 8.

What is claimed is:

1. A waste toner collecting device comprising:

a tubular member provided with a toner inlet and a toner outlet;

a roller that is provided upstream of the toner outlet in a toner transport direction inside the tubular member, that has a substantially horizontal rotation axis line, and that is elliptical in vertical section;

a scraper that is provided on an inner wall of the tubular member on a downstream side of the toner outlet in a rotation direction of the roller, an edge of the scraper being in contact with the roller;

a waste toner collecting bag that is inflatable and that is attached to the toner outlet of the tubular member; and a coagulation preventing mechanism, for preventing coagulation of waste toner is provided to operate in contact with the waste toner collecting bag.

2. The waste toner collecting device of claim 1, wherein the waste toner collecting bag is disposed to extend in a lateral direction.

3. The waste toner collecting device of claim 1, wherein the coagulation preventing mechanism is provided with a rod member that reciprocates in contact with the waste toner collecting bag in a direction in which the waste toner collecting bag extends.

4. The waste toner collecting device of claim 1, wherein the coagulation preventing mechanism is provided with an endless belt member that rotates in contact with the waste toner collecting bag in a direction in which the waste toner collecting bag extends.

5. The waste toner collecting device of claim 4, wherein the endless belt member has a projection formed on a surface thereof to project outward.

6. The waste toner collecting device of claim 1, wherein the coagulation preventing mechanism starts operating according to a predetermined cycle.

7. An image forming apparatus, comprising:

a waste toner collecting device, the waste toner collecting device including:

a tubular member provided with a toner inlet and a toner outlet;

a roller that is provided upstream of the toner outlet in a toner transport direction inside the tubular member, that has a substantially horizontal rotation axis line, and that is elliptical in vertical section;

a scraper that is provided on an inner wall of the tubular member on a downstream side of the toner outlet in a rotation direction of the roller, an edge of the scraper being in contact with the roller;

a waste toner collecting bag that is inflatable and is attached to the toner outlet of the tubular member; and a coagulation preventing mechanism, for preventing coagulation of waste toner, that operates in contact with the waste toner collecting bag.

8. The image forming apparatus of claim 7, wherein toner of a plurality of colors is used, and there is only one said waste toner collecting device for collecting the toner of all the plurality of colors.

* * * * *